US010369390B2

(12) United States Patent
Levy

(10) Patent No.: US 10,369,390 B2
(45) Date of Patent: Aug. 6, 2019

(54) ARRANGEMENT IN SUPERPOSABLE SAFETY BELT WITH DISENGAGEABLE RINGS

(71) Applicant: Jaques Lesser Levy, São Paulo (BR)

(72) Inventor: Alain Clement Lesser Levy, Sao Paulo (BR)

( * ) Notice: Subject to any disclaimer, the term of this patent is extended or adjusted under 35 U.S.C. 154(b) by 0 days.

(21) Appl. No.: 15/756,831

(22) PCT Filed: Mar. 23, 2016

(86) PCT No.: PCT/BR2016/000032
§ 371 (c)(1),
(2) Date: Mar. 1, 2018

(87) PCT Pub. No.: WO2017/035612
PCT Pub. Date: Mar. 9, 2017

(65) Prior Publication Data

US 2018/0272162 A1 Sep. 27, 2018

(30) Foreign Application Priority Data

Sep. 2, 2015 (BR) ..... 20 2015 0213005

(51) Int. Cl.
*A62B 35/00* (2006.01)

(52) U.S. Cl.
CPC ..... *A62B 35/00* (2013.01); *A62B 35/0025* (2013.01)

(58) Field of Classification Search
CPC ..... A62B 35/00
See application file for complete search history.

(56) References Cited

U.S. PATENT DOCUMENTS 1,685,671 A * 9/1928 Hardesty ..... H02P 1/46 307/87
2,166,777 A * 7/1939 Walker ..... A62B 35/00 182/4
2,834,525 A * 5/1958 Shawgo ..... A62B 35/0031 182/9
4,413,358 A * 11/1983 Jimenez ..... A41F 9/005 2/311
5,362,295 A * 11/1994 Nurge ..... A63B 21/00061 482/121

(Continued)

*Primary Examiner* — Alvin C Chin-Shue
(74) *Attorney, Agent, or Firm* — Scott Houtteman; Houtteman Law LLC

(57) ABSTRACT

The object of this patent application consists of a safety belt to be overlaid on the original back portion of the seat belt air belonging to the field of safety engineering, whose technique allows the rapid detachment by third parties, with the pull of a single rigging included, for the case where the user on air position is unable to do so in the case of rescue, more specifically the overlay safety belt with disengageable rings (1) that includes a lumbar belt (2), with an elongated base strip (3), which is stitched over, another upper strip (4), which overlaps the original belt, the base strap (3) over which there is another woven upper strip (4) whose set overlaps itself to the original belt, and the base strip (3) has, at each end, a hinged end that lays down the original air safety belt end buckles, upper strip (4) features an engagement fold (6), preceded by a grommet (8), and a double rigging (10), has its ends equipped with a metallic pin (11).

3 Claims, 3 Drawing Sheets

(56) References Cited

U.S. PATENT DOCUMENTS

Figure 1:
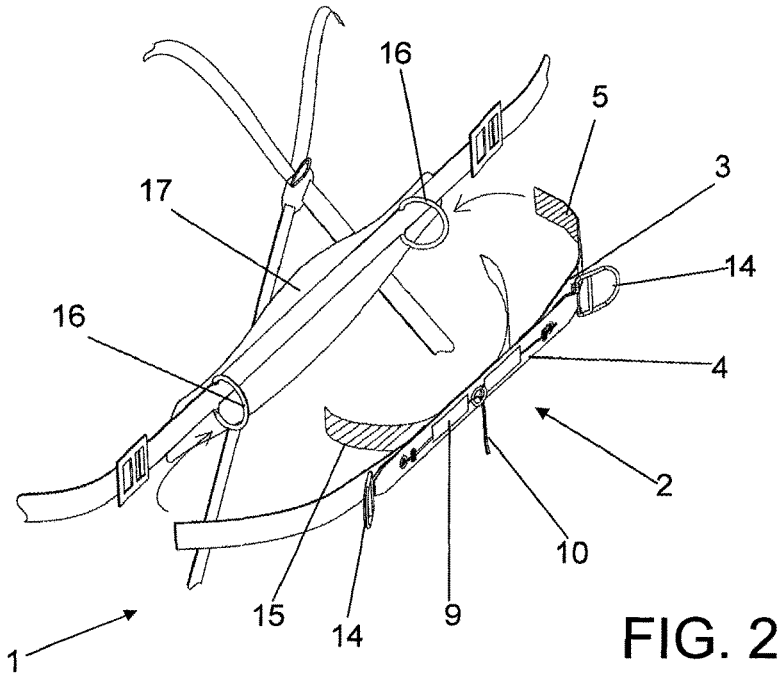

| | | | | |
|---|---|---|---|---|
| 5,484,395 | A * | 1/1996 | DeRoche | A61F 5/028 128/100.1 |
| 5,813,955 | A * | 9/1998 | Gutkowski | A63B 21/0004 482/121 |
| 6,766,532 | B1 * | 7/2004 | Cabana | A61F 5/026 2/310 |
| 8,333,262 | B1 * | 12/2012 | Carpenter | A62B 35/0031 182/6 |
| 8,795,214 | B1 * | 8/2014 | Conti | A61F 5/02 602/19 |
| 8,864,695 | B2 * | 10/2014 | Thornton | A61F 5/028 128/96.1 |
| 9,737,737 | B2 * | 8/2017 | Rullo | A62B 35/0025 |
| 2004/0077981 | A1 * | 4/2004 | Weaver, II | A61F 5/028 602/19 |

* cited by examiner

ARRANGEMENT IN SUPERPOSABLE SAFETY BELT WITH DISENGAGEABLE RINGS

INVENTION FIELD

This patent of utility model belongs to the field of safety equipment and is a practical and innovative object model of a lumbar back safety belt to upkeep the positioning of workers who perform services in high places, whose technology disengage their side rings, in order to disconnect the straps, on fixed structures, by means of an attached rigging driven by a third person, in cases where the user is temporarily unable, and to which the original constructive data had been provided, aiming at improving its utilization and performance in relation to other models of abdominal belts for positioning and support usually found on the market.

It shows a belt with disengageable rings in the distance, which overlaps the back belt that integrates the safety belt in uneven-level services, thus it introduces a new technology to these safety belts, without the need to drop the original belt and further making it highly economical without compromising safety, increasing it otherwise.

Such application also aims at presenting a model of overlapping lumbar belt with low costs for your industrial feasibility, but allied to the requirements of robustness, safety and utility convenience, which offers an additional option to the public sector in the sister-airline market, which unlike the usual models of safety belts, offers countless possibilities and benefits to its users, making it a model of great sector market acceptance.

HISTORY OF THE INVENTION

The safety belts are built with sturdy polymer transverse strips horizontally, vertically and in oblique, whose intersection points between these are equipped with coupling rings to attach the workers to the latch and/or strap, in order to retain and provide security to workers who perform services in high or uneven leveled places.

These are responsible for preventing falls and keep workers attached to the rope, and are crucial to maintain the security and physical integrity of the staff. Performing activities at heights without them is extremely dangerous, also taking into account that it is illegal and its use is mandatory.

STATE OF THE ART DEFAULT ASPECTS

When the worker performs services in high places, in addition to the "Vertical Life Rope", it uses a positioning or constraining strap.

Such 'Vertical Life Rope" consists of a vertical (steel or nylon) cable that has one of its ends connected to an anchor point or retractable latch, and the other end is connected to the safety belt or sliding latch.

Positioning or constraining straps are devices consisting of high-strength nylon rope or polyester belt with forged steel carabiners. Strap's purpose is to secure the safety belt to the structure.

By having an accident or sudden pain, the employee will be suspended by the life rope and latch. In this case, the positioning strap fixed to the structure prevents its rescue, i.e., due to the positioning strap being fixed to the structure, the worker cannot be lowered onto the ground.

At this point the rescuer should climb up to the victim to loosen the belt strap, and leave the him/her attached to the lifeline only for the rescue, which occurs on ground.

We must agree this operation shows a great deal of upset to the rescuer, besides presenting certain risks and delays in rescuing.

One evident drawback in the market is that technological innovations applied in safety belts show fairly difficulty in entering public enterprises, as well as private companies.

This occurs due to these companies' and institutions' need to dispose of the old safety belts, in order to exchange them for newer and more modern ones in a technological point of view, and it is not always possible due to the laws in force, financial conditions and other adverse factors.

This commercial condition or difficulty in deploying new technologies apply to the introduction of new safety belts with disengageable rings, necessary condition and technology to rescue workers at heights, when he/she is unconscious due to an unexpected problem.

Therefore, the inventor has developed an overlaid safety belt with disengageable rings, which is installed by overlapping the original air belt and eliminates the need to discard air safety belts used by companies and public institutions referenced above.

INVENTION SUMMARY

Due to the need to develop a safety device to apply in safety belts so to not discard them, reinforcing them with new technologies, led the inventor, a person related to the business, to create and develop this object of patent which comprises a safety device that takes a new technology and utility feature that can be applied to safety belts without the need to exchange them for new ones, since it innovates with a support belt that overlaps on the original belt by attaching into their side rings hip and lumbar area.

The new rings set on the original rings, due to the installation of a belt to the part overlapping the original lumbar belt, on which it is settled, allows them to be disengaged by pulling on a rigging attached to them, through a person who is away from the user in cases involving accidents.

By disengaging the new threaded rings, the worker can be rescued more promptly and without any risk to third parties, when there is a rescue operation.

We can understand the overlaid belt for the safety belt in question is extremely simple in your constructiveness, therefore, it is easily feasible, however, it obtains excellent practical and functional results, offering an innovative constructiveness on the known models.

Designed with an innovative drawing, it brings a harmonic set of a peculiar and, above all, typical aspect, and besides the constructive aspect, the model stands out due to its versatility and use convenience.

BRIEF DESCRIPTION OF DRAWINGS PROVIDED

For better further understanding and comprehension of how the disposition introduced in overlaid belt with disengageable rings consists of, which claims herein, illustrative drawings are presented in the attachment, where we can see;

FIG. 1—Shows an upper-back perspective view of the overlaid belt with disengageable rings, as they are engaged to a conventional safety belt, where arrows indicate where their ends will come across.

Figure 2:
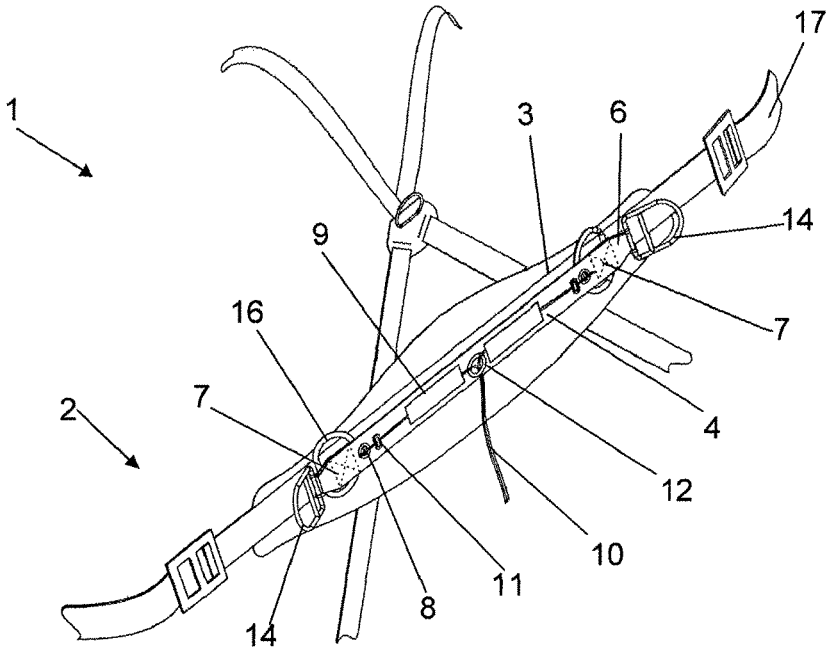

FIG. 2—Shows another upper-back perspective view of the overlaid safety belt with disengageable rings coupled to a conventional safety belt.

Figure 3:
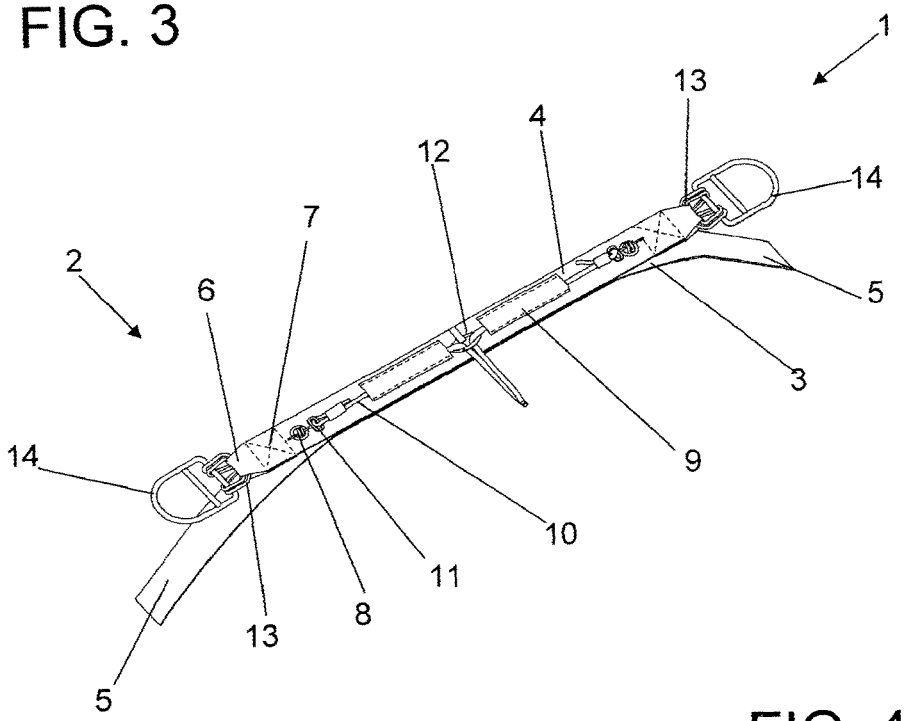

FIG. 3—Shows an upper perspective view of the overlaid safety belt with disengageable rings.

Figure 4:
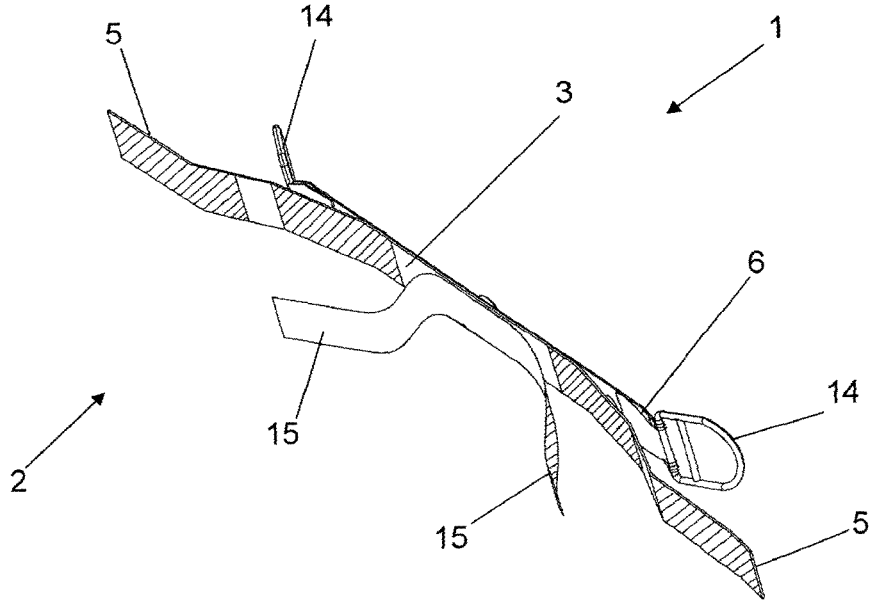

FIG. 4—Shows a back-perspective view of the overlaid safety belt with disengageable rings.

Figure 5:
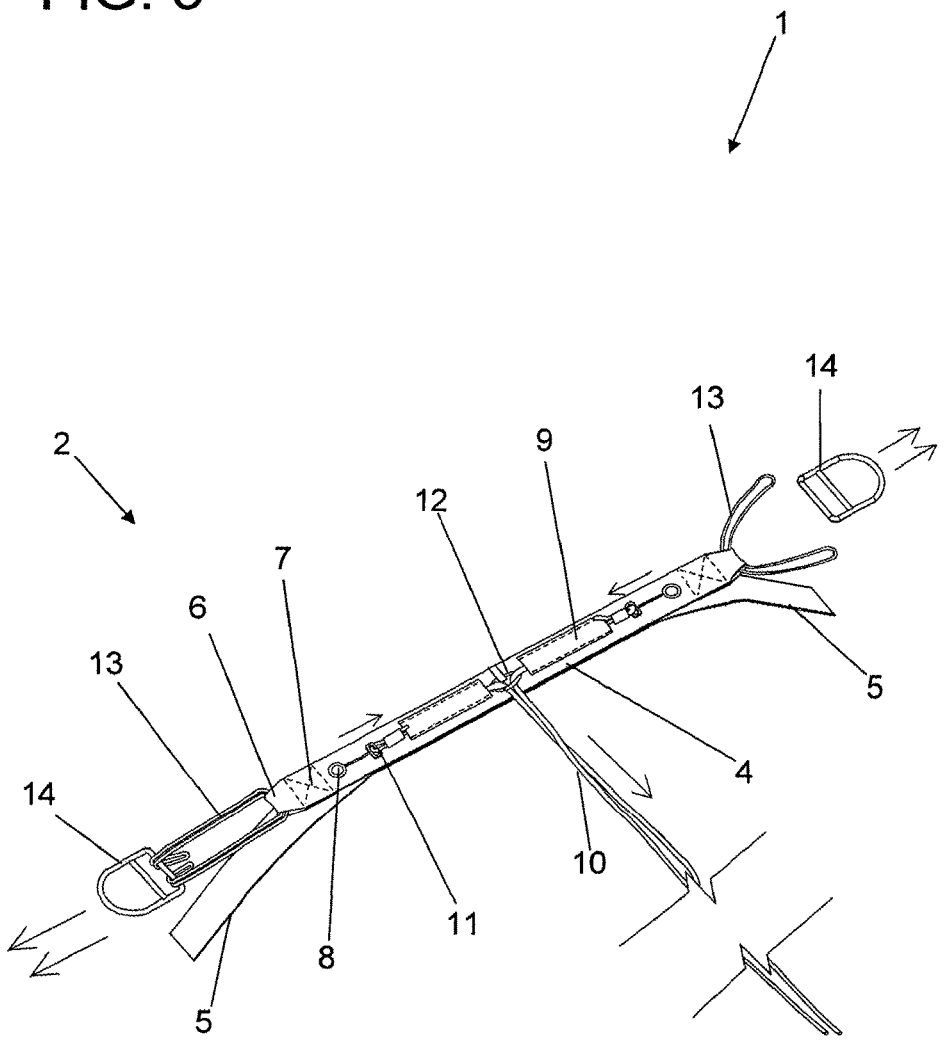

FIG. 5—Shows an upper perspective view of the overlaid safety belt with loose disengageable rings.

DETAILED DESCRIPTION OF THE INVENTION

According to the illustration in the figures above on how the related disposition introduced in overlaid belt with disengageable rings, object of this patent, consists of a vest-type safety belt accessory to protect and stabilize the user in services performed at heights, whose technology comprises a belt that overlaps its original (lower back) safety belt, in order to be able to release him from a distance, when the user is unable to do so, therefore, allows it to be taken by a third person in an innovative manner.

This overlaid belt has its ends connected to the original safety belt side rings (on which the strap carabiners would be affixed) through the strips with Velcro fasteners and it has two other rings equally positioned, however, able to be released along with the strap (structural fixed back strap), if there is the need to rescue the user who finds himself/herself in a risk situation and to be inoperable, in such heights, without requiring the first rescuer to climb up the place to disconnect the strap from the lumbar belt rings in order to lower the temporarily incapacitated (fainted) worker down, sustained by a life rope, set to other safety belt anchorage points, provided that they keep the user in totally safe conditions.

The overlaid belt can be manufactured in different ways and with different materials, since it depends on its function, but it is usually made by a texture technique, using strands of polyester, nylon, polyamide etc.

Operation of the Overlapping Safety Belt

The lumbar seat belt on which it attaches to a fixed strap in fixed structures is a necessary option to equip such safety belts, usually set to other additional rings and it focus on the comfort of a worker executing the service and how to ensure his/her safety.

First, there was a time when this PPE was attached to the belt dorsal part and, on the other hand, when Brazil began to carry out imports of more modern models, with more anchor rings, industry began to modernize and provide more options for professionals, as well as for imported safety belts.

More recently, it became mandatory to use front and rear double "Y" latch element, along to the safety belt set, and thus offer more modern vest-type belts, which offer several attachment or ring options for crimping, and not only on the dorsal area.

Knowing all the anchorage points means the user can choose the way it is most convenient for the function performance.

The overlaid safety belt with disengageable rings (1) includes a lumbar belt (2), equipped with an elongated base strip (3), woven, produced with synthetic strands, which is stitched in its center, another upper strip (4) of smaller length, woven, containing synthetic strands as well, which overlaps the original belt, in the same back abdominal area.

In order to fix them to the side rings (18) of the safety belt (17), the base strap (3) has a convergent hinged end (4) at each end that gets fixed to that structure through velcro-type couplings over which, after being folded, attaches and overlaps to a divergent and opposed bluffed strip (15), fixed with velcro as well.

The upper strip (4) features an engagement fold (6) at each end, fixed to such structure with reinforced stitching (7), preceded by a grommet (8), and along the upper strap (4) it is attached under a lining (9), a double rigging (10), whose outer ends are equipped with a metallic pin (11) and common ends hanging through a interspearse wheel (12) set to the external center of the upper strip (4).

A double rigging (13) connected by a specific technique by respective engagement folds (6) and, that finish across by the grommets (8), providing support and fixing the respective allocated disengageable ring (14), each at the ends of the strip (4), which can be disconnected after a manual pull by the common ends of double riggings (10), showing a substantial length.

To provide a better finishing, a soft woven sleeve covers the upper strap (4) in the metallic pin (11) crimping area of the rigging (10) and (13), where it gets overlapped both crosswise, by a woven clamp equipped with velcro, which also involves the base strap (3) and upper strap (4).

Therefore, this descriptive report depicts a new design of overlaid safety belts, as it can be seen by analyses carried out and figures shown, numerous differences over conventional models of individual safety equipment for the same purpose on the market, as well as constructive and functional technical characteristics quite different from those relevant to the state of the art.

By the advantages it offers, and still, for showing truly innovative features that meet all the requirements as to innovation and originality in the genre, this disposition introduced in overlaid safety belt with disengageable rings gather the conditions needed to merit a patent of utility model.

The invention claimed is:

1. A lumbar belt useful for attachment to safety belts and for remotely releasing a worker from attachment to a structure comprising:

a base strip, an intersperse wheel, two grommets, two pin, and two disengageable rings, primary double rigging and two secondary double riggings;

wherein said intersperse wheel is mounted in the center of the base strip and the primary double rigging further comprising two parallel lines, a first end of which extends out from the base strip, the other end of which passes through the intersperse wheel, after passing through said intersperse wheel the parallel lines separate such that one line travels along the surface of the base strip toward one end of the strip and the other line travels along the surface of the base strip toward other end of the strip, each of the ends of the strip are configured with one of the pins, grommets and disengageable rings such that the line traveling toward each respective end engages and terminates at a top of the pin, said pin being removably engaged with the grommet, the bottom of the pin being removably engaged with a respective one of the two secondary double rigging, each secondary double rigging also engaged, by way of engagement folding, to each disengageable ring, said pins are configured such that when the first end of the primary double rigging is pulled the pins disengage from the secondary double riggings which, in turn releases the disengageable rings;

wherein said release of the disengageable rings results in the worker being released from the structure.

2. The lumbar belt of claim 1 further comprising a structure for attachment to a safety belt.

3. The lumbar belt of claim 1 further comprising material selected from the group consisting of: polyester, nylon and polyamide.

* * * * *